US012595667B2

(12) United States Patent
Squinzi et al.

(10) Patent No.: US 12,595,667 B2
(45) Date of Patent: Apr. 7, 2026

(54) UNIVERSAL SUPPORT FOR RAISED FLOORS, WITH OPEN RING LOCKING THE TILTING FUNCTION

(71) Applicant: MAPEI S.p.A., Milan (IT)

(72) Inventors: Marco Squinzi, Milan (IT); Andrea Annoni, Lomazzo (IT)

(73) Assignee: Mapei S.p.A., Milan (IT)

( * ) Notice: Subject to any disclaimer, the term of this patent is extended or adjusted under 35 U.S.C. 154(b) by 117 days.

(21) Appl. No.: 18/632,634

(22) Filed: Apr. 11, 2024

(65) Prior Publication Data

US 2024/0254782 A1 Aug. 1, 2024

(51) Int. Cl.
*E04F 15/024* (2006.01)

(52) U.S. Cl.
CPC .. *E04F 15/02482* (2013.01); *E04F 15/02464* (2013.01); *E04F 15/0247* (2013.01)

(58) Field of Classification Search
CPC ..... E04F 15/02464; E04F 15/02482; E04F 15/0247
USPC ..... 52/126.6
See application file for complete search history.

(56) References Cited

U.S. PATENT DOCUMENTS

| | | | | |
|---|---|---|---|---|
| 7,866,096 | B2 * | 1/2011 | Lee | E04F 15/02488 52/302.5 |
| 9,284,693 | B2 * | 3/2016 | Tabibnia | F24D 3/122 |
| 9,410,296 | B2 * | 8/2016 | Tabibnia | E04F 15/02447 |
| 9,803,377 | B2 * | 10/2017 | Pelc, Jr. | E04F 15/0247 |
| 10,900,240 | B2 * | 1/2021 | Bordin | E04F 15/02452 |
| 11,486,148 | B2 | 11/2022 | Bassetto et al. | |
| 2008/0222973 | A1 * | 9/2008 | Lee | E04F 15/02488 52/126.6 |
| 2010/0205874 | A1 * | 8/2010 | Zlatar | E04F 15/02452 52/126.6 |
| 2014/0308076 | A1 * | 10/2014 | Tabibnia | E04F 15/02452 404/99 |
| 2015/0184398 | A1 * | 7/2015 | Tabibnia | E04B 5/48 52/126.6 |
| 2016/0040439 | A1 * | 2/2016 | Pelc | E04F 15/0247 52/126.6 |
| 2017/0152665 | A1 * | 6/2017 | Pelc, Jr. | E04B 1/003 |

(Continued)

FOREIGN PATENT DOCUMENTS

| | | |
|---|---|---|
| EP | 3733994 | 11/2020 |
| RU | 193541 | 11/2019 |
| WO | WO 2014160076 | 10/2014 |

OTHER PUBLICATIONS

Italian Search Report.

*Primary Examiner* — Brent W Herring
(74) *Attorney, Agent, or Firm* — Dunlap Bennett & Ludwig PLLC

(57) ABSTRACT

A support (1) for raised floors comprising a base (2), an intermediate element (3) and a head (4) on which raised floor portions rest. The support (1) is of the universal type, namely it allows selectively both a tilting movement of the head (4) on the intermediate element (3), and only a rotation movement of the head (4) on the intermediate element (3) about an axis perpendicular to a plane on which the base (2) rests. The intermediate element (3) is centrally provided with a circular element (80) that comprises a circular neck (81) from which the teeth (8) protrude outwards. The support (1) further comprises an open ring (100) adapted to be reversibly coupled to the circular neck (81) under the teeth (8).

7 Claims, 7 Drawing Sheets

(56) References Cited

U.S. PATENT DOCUMENTS

| | | | | |
|---|---|---|---|---|
| 2019/0368203 | A1* | 12/2019 | Bordin | E04F 15/02476 |
| 2020/0039801 | A1* | 2/2020 | Sargent | E04D 11/007 |
| 2021/0262243 | A1* | 8/2021 | Bassetto | E04F 15/02464 |

* cited by examiner

UNIVERSAL SUPPORT FOR RAISED FLOORS, WITH OPEN RING LOCKING THE TILTING FUNCTION

BACKGROUND OF THE INVENTION

The present invention relates to a universal support for raised floors, with open ring locking the tilting function.

The creation of raised floors is increasingly widespread since it is fast, involves easy installment, while being adaptable to heterogeneous support planes both in relation to orientation and material.

The quality of the work strongly depends on the supports on which the flat elements which form the raised floor rest.

Each support is notoriously formed by at least one base element and by a head for resting said flat elements. The support may have a non-tilting head simply rotating about an axis perpendicular to the ground on which the base rests, or a different tilting head.

The prior art further comprises supports with devices able to transform a head from tilting to simply rotating on the axis perpendicular to the ground without tilting function. These supports are of the universal type, in the sense that they perform both functions, the simple rotation about the axis perpendicular to the ground and the tilting function.

For example, EP-3733994 describes a universal support for raised floors comprising a base, an intermediate element and a head on which raised floor portions rest. The base comprises a cylindrical cavity having an internal thread, and the intermediate element has a cylindrical shape with an external thread and comprises a curved upper surface and centrally, teeth. Each tooth comprises a portion which protrudes outwards leaving a space below. The head comprises an upper portion with an outer upper surface which is flat, and a central compartment comprising a central surface with a central through hole. The head further comprises a lower portion with a curved surface. The through hole is provided with curved edges interrupted by loops which protrude outwards to allow the passage from below of the teeth through the through hole. The curved upper surface of the intermediate element is able to slidably couple with the curved surface of the lower portion of the head.

The intermediate element has a circular groove on the edge of the curved upper surface.

A ring is able to engage in said lower groove, the ring comprising an upper edge able to interact with the lower portion of the head, and a lower edge which may be separately associable with the groove of the intermediate element.

Advantageously, the same head and the same intermediate element are used, adding the ring in case the tilting function is to be blocked. In the presence of the ring, the head may only rotate about an axis perpendicular to the plane on which the base rests.

Disadvantageously, the solution proposed in EP-3733994 requires creating a groove on the edge of the intermediate element, as well as providing a ring to be sized precisely for an optimal interaction with both the head and the intermediate element. The ring is also very bulky.

U.S. Pat. No. 11,486,148 describes an alternative universal support for raised floors comprising a ring which is separably associable by screwing to a central element of the intermediate element. The ring is able to disable the tilting function.

Although the ring is small in size, the solution proposed in U.S. Pat. No. 11,486,148 involves the need to create a thread in the ring and on the central element of the intermediate element, namely, a manufacturing complication which increases manufacturing times and costs.

RU-193541 describes a support for raised floors comprising a base, an intermediate element and a head on which raised floor portions rest. The support allows a tilting movement of the head on the intermediate element.

WO-2014/160076 describes a support for raised floors comprising a base, an intermediate element and a head on which raised floor portions rest. The support allows both a tilting movement of the head on the intermediate element, as well as a rotation movement of the head on the intermediate element about an axis perpendicular to a plane on which the base rests.

SUMMARY OF THE INVENTION

It is the object of the present invention to create a universal support for raised floors which provides means able to lock the tilting function that are simple to implement.

It is a further object of the present invention that said means for locking the tilting function limit the need to modify the shape of the head and/or of the intermediate element.

It is another further object of the present invention that said means for locking the tilting function are simple to use and to maintain in the event of using the tilting function.

In accordance with the invention, said and further objects are achieved by a support for raised floors comprising a base, an intermediate element and a head on which raised floor portions rest, wherein the support is of the universal type, namely it allows selectively both a tilting movement of the head on the intermediate element, and only a rotation movement of the head on the intermediate element about an axis perpendicular to a plane on which the base rests, wherein the base comprises a cylindrical cavity having an internal thread, the intermediate element has a cylindrical shape with an external thread and comprises a curved upper surface and centrally teeth, wherein each tooth protrudes outwards leaving a space below, the head comprises an upper portion with an outer upper surface which is flat, and a central compartment comprising a central surface with a central through hole, the head further comprises a lower portion with a curved surface, the through hole is provided with curved edges interrupted by loops which protrude outwards to allow the passage from below of the teeth through the through hole, the curved upper surface of the intermediate element being able to slidingly couple with the curved surface of the lower portion of the head, characterized in that the intermediate element is centrally provided with a circular element which comprises a circular neck from which the teeth protrude outwards, wherein the support further comprises an open ring adapted to be reversibly coupled to the circular neck under the teeth, wherein the tilting movement of the head on the intermediate element is enabled when the open ring is decoupled from the circular neck, and is disabled when the open ring is coupled to the circular neck, wherein, when the open ring is coupled to the circular neck and the internal edge of the through hole of the head is in contact with the external edge of the open ring, the head can only rotate on the intermediate element about an axis perpendicular to the plane on which the base rests, the open ring being elastic so as to be able to deform elastically in order to embrace the circular neck.

Advantageously, with the same base, the same head and the same intermediate element it is possible to create two types of supports, one with a tilting function (without an open ring) and one without a tilting function (with an open ring coupled to the circular neck).

The support according to the present invention is able to transform from non-tilting to tilting simply by using or not using the open ring.

The use of the open ring is very simple, being elastic and easily maneuverable by the user: a slight widening of the opening of the open ring due to elastic deformation allows the circular neck to be embraced.

DESCRIPTION OF THE DRAWINGS

These and other features of the present invention will become more apparent from the following detailed description of a practical exemplary embodiment thereof, shown by way of non-limiting example in the accompanying drawings, in which.

DETAILED DESCRIPTION OF THE INVENTION

Figure 1:
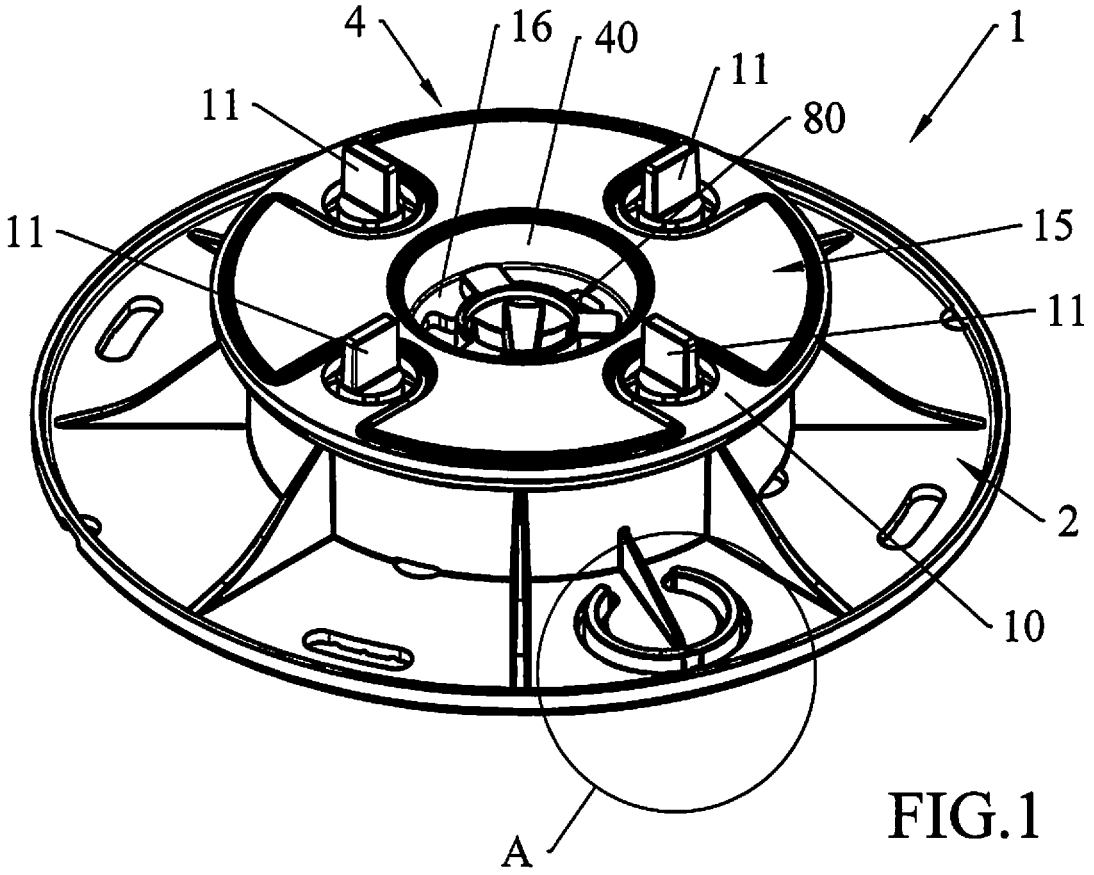
FIG. 1 shows a perspective view of a support according to the present invention.
Figure 3:
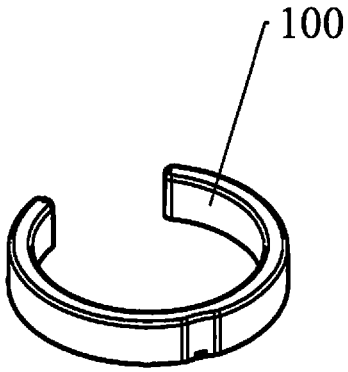
FIG. 3 shows a perspective view of an open ring.
Figure 2:
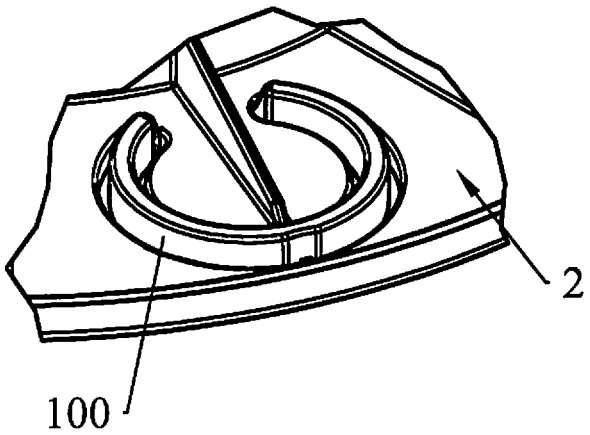
FIG. 2 shows the enlarged content of circle A in FIG. 1.

A support 1 for raised floors comprises a base 2, an intermediate element 3 and a head 4 (FIG. 1-5). The support 1 is of the universal type, namely it allows selectively both a tilting movement of the head 4 on the intermediate element 3, as well as a simple rotation movement of the head 4 on the intermediate element 3 about an axis perpendicular to a plane on which the base 2 rests.

The base 2 is able to rest on a fixed underlying surface and comprises a cylindrical cavity 5 having an internal thread 51 able to engage with an external thread 6 of the intermediate element 3.

Figure 6:
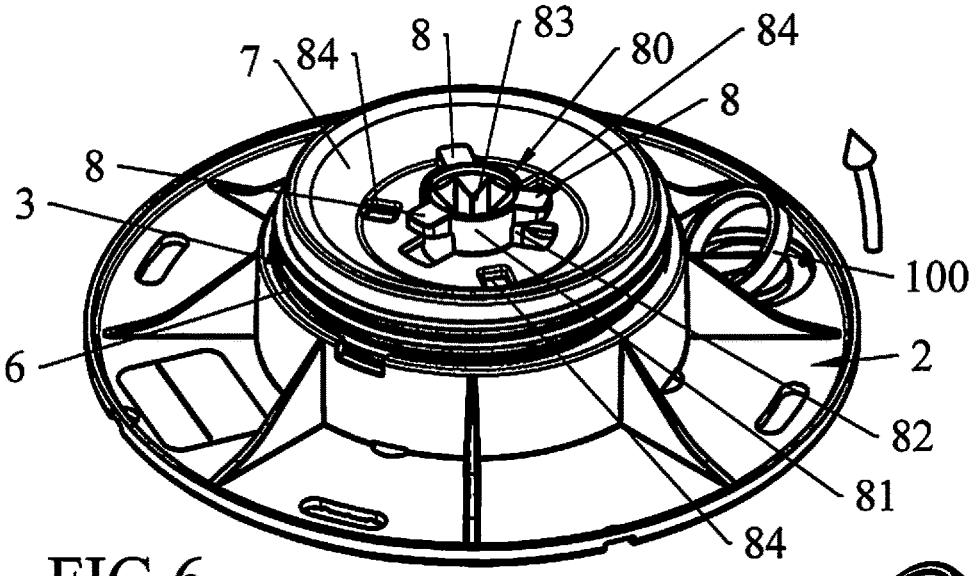
FIG. 6 shows a perspective view of the support without the head, in a first step of mounting the open ring.
Figure 7:
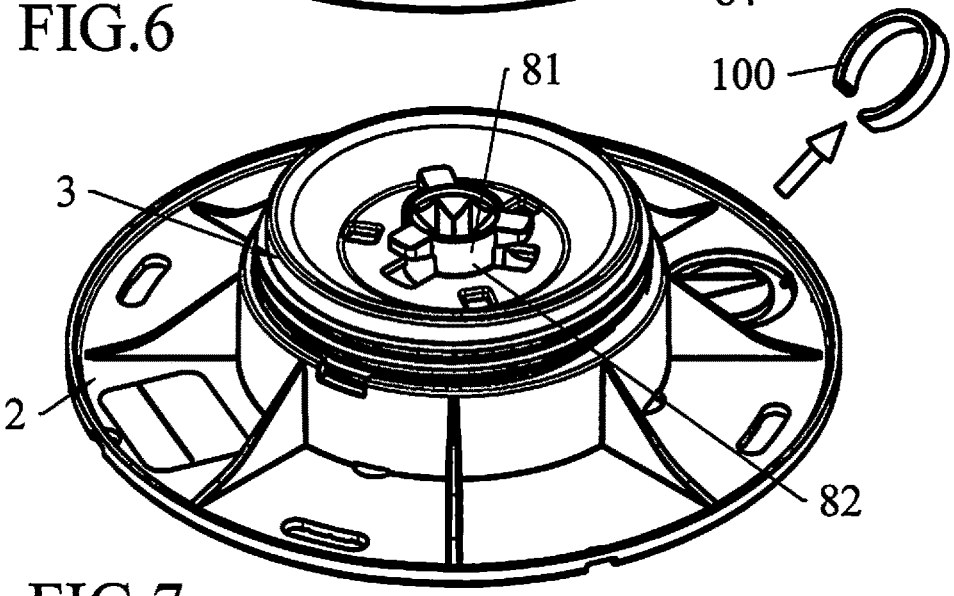
FIG. 7 shows a perspective view of the support without the head, in a second step of mounting the open ring.
Figure 8:
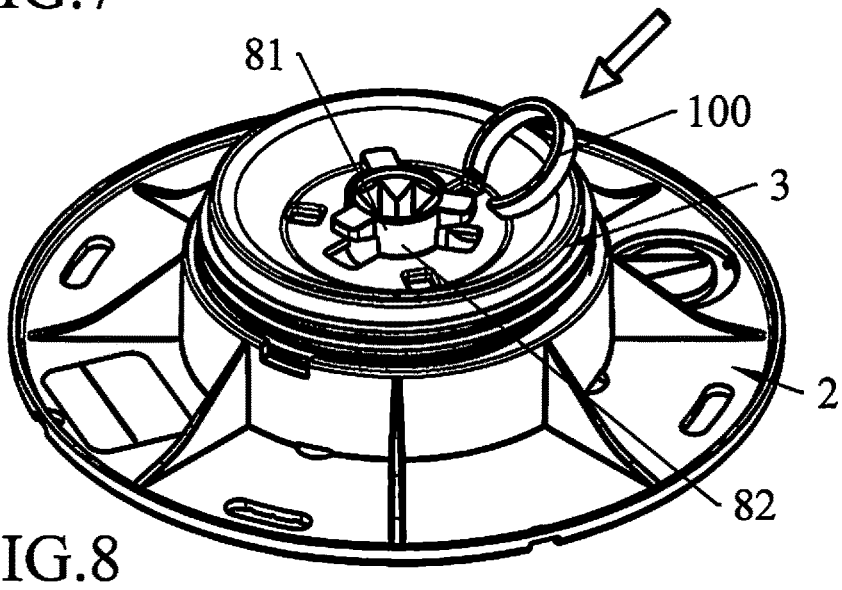
FIG. 8 shows a perspective view of the support without the head, in a third step of mounting the open ring.
Figure 9:
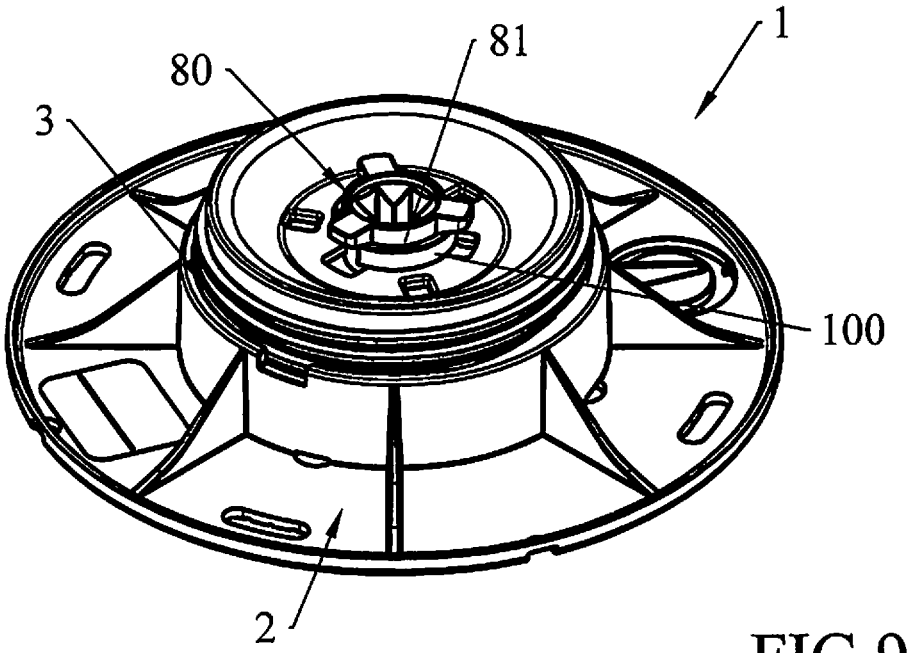
FIG. 9 shows a perspective view of the support without the head, after mounting the open ring.
Figure 10:
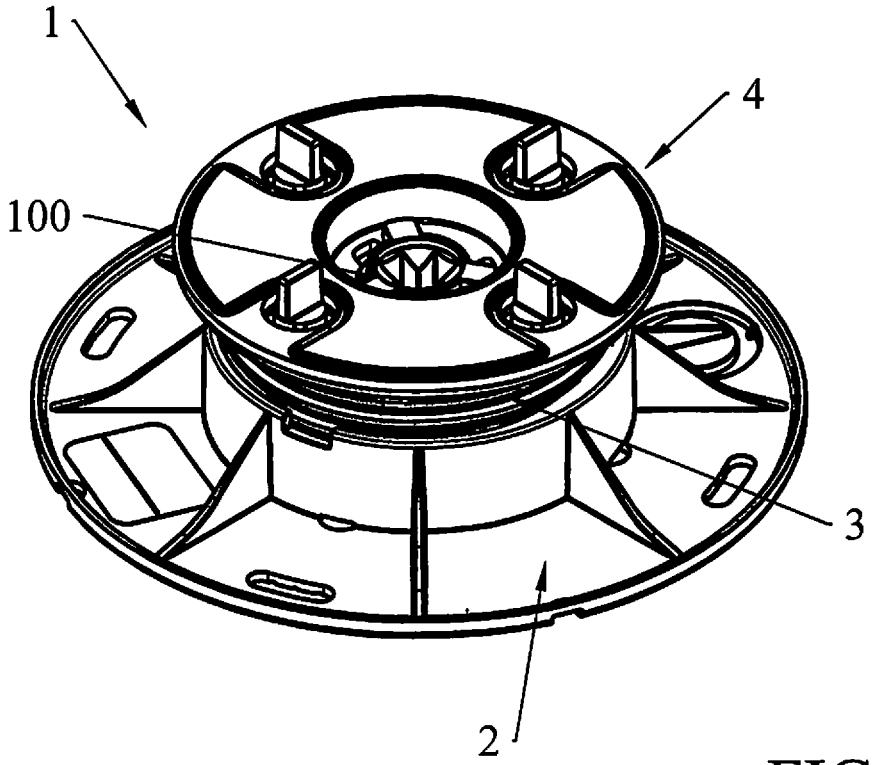
FIG. 10 shows a perspective view of the support with the head in FIG. 1, after mounting the open ring.
Figure 11:
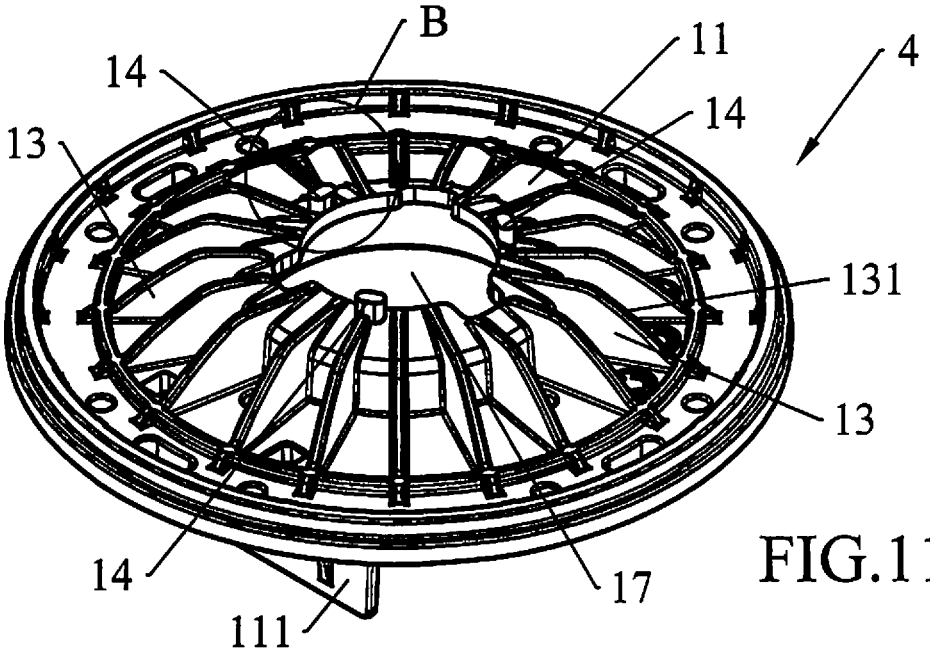
FIG. 11 shows a bottom perspective view of a head of the support in accordance with a different embodiment.
Figure 12:
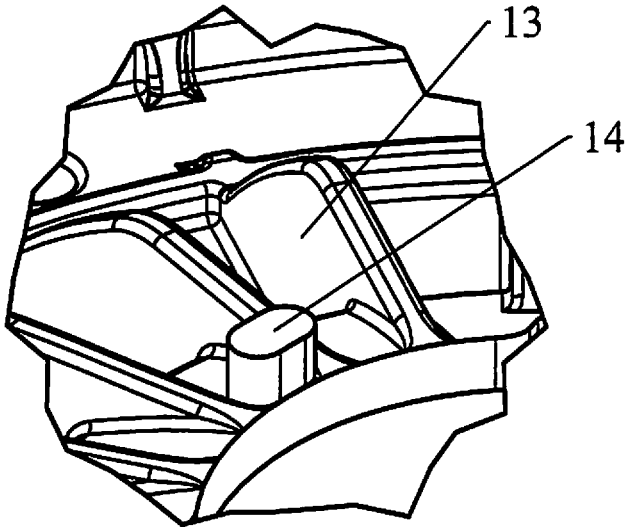
FIG. 12 shows the enlarged content of circle B of FIG. 11.
Figure 13:
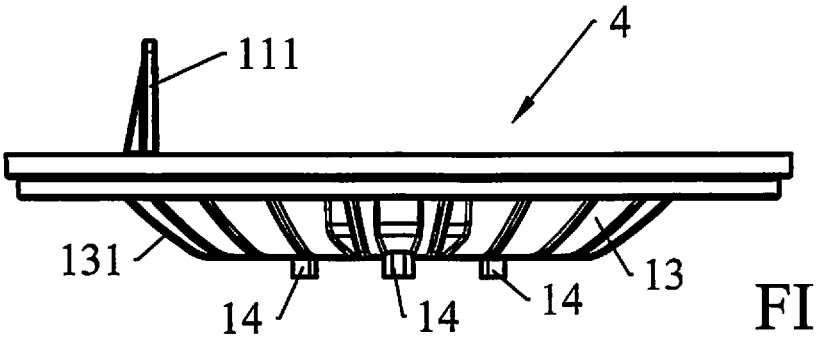
FIG. 13 shows a side view of the head of FIG. 11.
Figure 14:
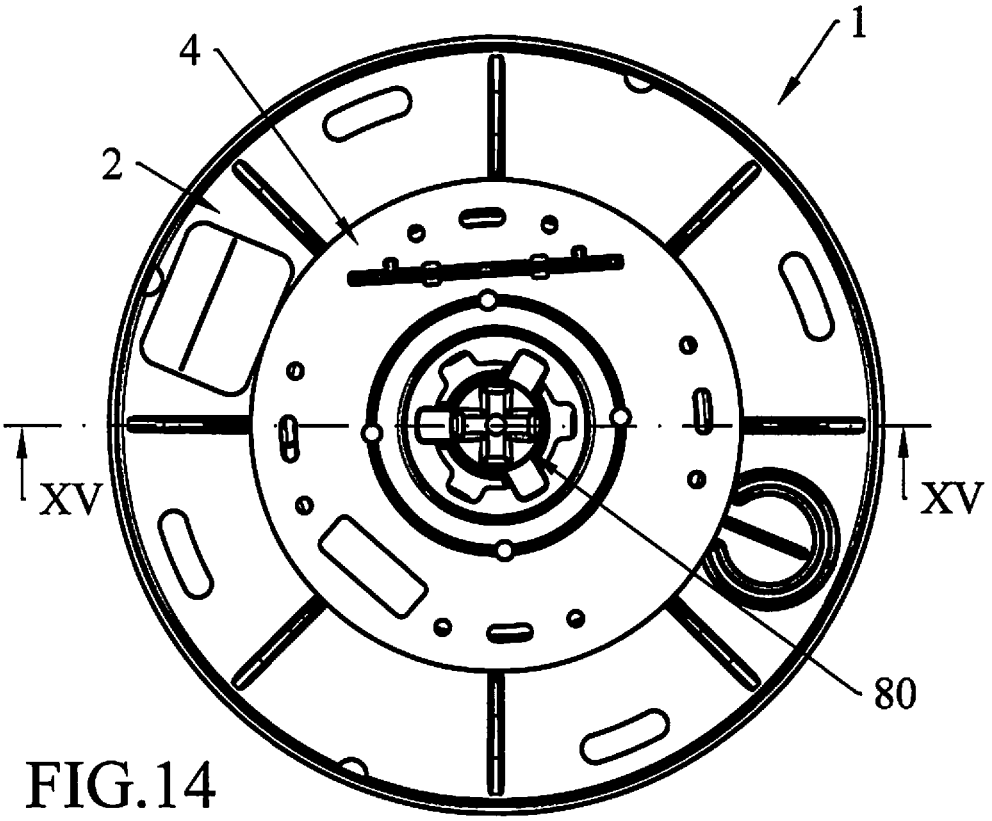
FIG. 14 shows a top plan view of the support, with the head of FIG. 11.
Figure 16:
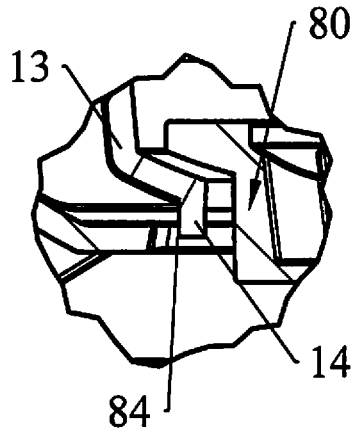
FIG. 16 shows the enlarged content of circle C of FIG. 15.
Figure 15:
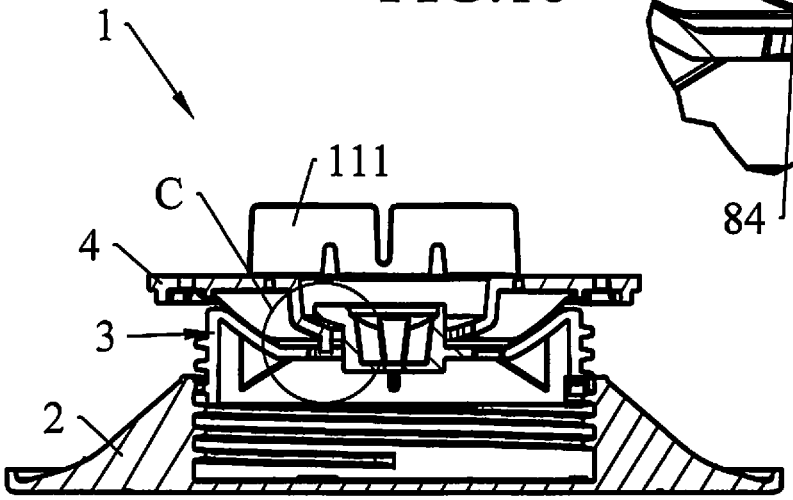
FIG. 15 shows a sectional view along line XV-XV of FIG. 14.

The intermediate element 3 has a cylindrical shape with said external thread 6, and comprises a concave upper surface 7 (FIG. 6) that centrally comprises a circular element 80 which comprises a circular neck 81 and teeth 8 which protrude from said circular neck 81 towards the external edge of the concave upper surface 7. The teeth 8 are placed substantially on the top of the circular neck 81 leaving a space underneath the teeth 8 themselves, namely, between the teeth 8 and a central portion of said concave upper surface 7. More in particular, a circular surface 82 is provided under the teeth 8 on the circular neck 81. The circular element 80 comprises a cross attachment 83 for a maneuvering tool.

The continuity of the concave upper surface 7 is possibly interrupted by locking seats 84 for possible locking teeth 14 which may be found on a different embodiment of the head 4 shown in FIGS. 11-16, as it will become clearer below.

The support 1 further comprises an open ring 100 (FIG. 3) which is able to be reversibly coupled to the circular surface 82 of the circular neck 81 of the circular element 80 to disable the tilting function, namely, the tilting movement of the head 4 on the intermediate element 3. When the open ring 100 is coupled to the circular surface 82, the head 4 may only rotate on the intermediate element 3 about an axis perpendicular to the plane on which the base 2 rests.

The open ring 100 is preferably made integral with the base 2 with breakable connections so that it may be easily and irreversibly separated from the base 2.

Open ring 100 means a ring without a portion that defines a lateral opening able to allow the passage of the circular neck 81 inside the open ring 100.

The open ring 100 is elastic so as to be able to deform elastically, thus widening the lateral opening in order to embrace the circular neck 81.

The inner diameter of the undeformed open ring 100 is substantially equal to the outer diameter of the circular neck 81, so that the open ring 100 embraces the circular neck 81 preferably allowing the sliding of the open ring 100 on the circular surface 82 of the circular neck 81.

The head 4 comprises an upper portion 15 with an outer upper surface 10 which is substantially flat and with teeth 11 protruding upwards, and a central compartment 40 having a central surface 16 with a central through hole 17. Said central surface 16 is preferably concave to facilitate the sliding of the teeth 8 that preferably have a convex lower surface.

The head 4 further comprises a lower portion 12 with ribs 13 having a convex edge 131 (namely a curved surface) which converges towards said central through hole 17.

In the embodiment of FIGS. 11-16, the lower portion 12 of the head 4, substantially at the edge of the central through hole 17, also provides the aforesaid locking teeth 14 able to couple with the locking seats 84 of the intermediate element 3.

It is essential that at least one (convex) curved surface of the lower portion 12 is there, which is able to slide on at least one concave portion of the intermediate element 3 below. It is not necessary for said (convex) curved surface to partially or completely have the shape of a set of edges 131 of ribs 13 which, however, advantageously stiffen the lower portion 12.

The central through hole 17 is provided with curved edges 171 (FIG. 4) interrupted by loops 172 which protrude outwards substantially up to a lower edge of the central compartment 40.

The central surface 16 comprises portions embedded between consecutive loops 172.

Figure 4:
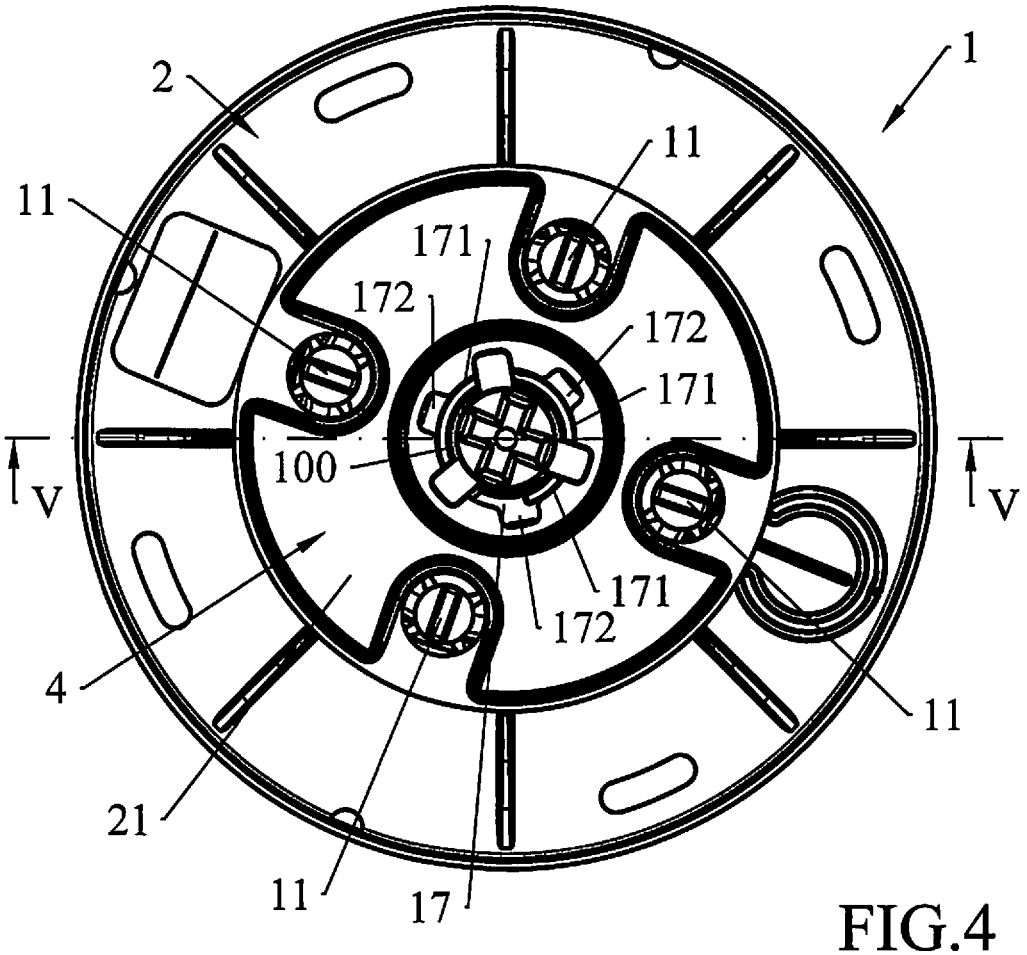
FIG. 4 shows a top plan view of the support, with the open ring.
Figure 5:
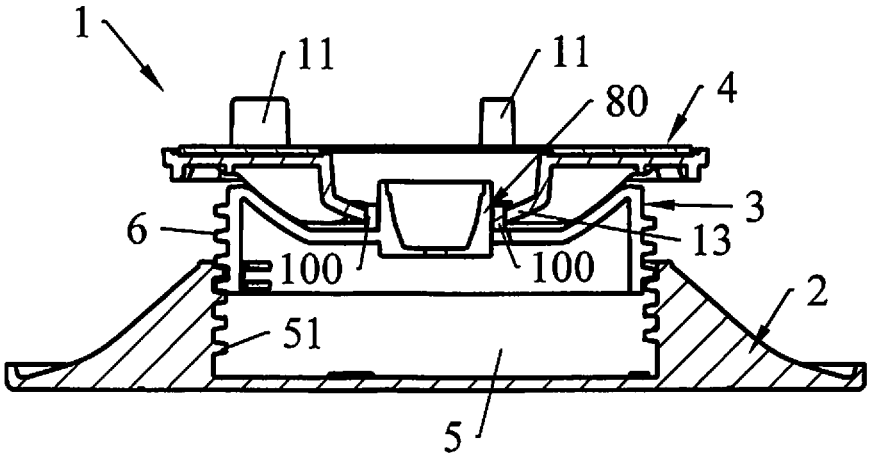
FIG. 5 shows a sectional view taken along line V-V in FIG. 4.

An anti-noise sheath 21 may be separably coupled to the outer upper surface 10 of the head 4 (FIG. 4). The planes of the raised floor rest on the anti-noise sheath 21: advantageously, any movements following the laying of said planes on the anti-noise sheath 21 are not felt.

The teeth 11 are integral with the head 4 by frangible connections, so as to easily remove the excess teeth 11.

FIGS. 11-16 show a head 4 without teeth 11, but with a bulkhead 111 for a beam in wood, aluminum, PVC or other material.

The lower portion 12 of the head 4 in FIGS. 1, 4, 5 and 10 is the same as the head in FIGS. 11-16 except for the presence of the locking teeth 14.

Thea assembly of the support 1 described above is very simple.

The intermediate element 3 is screwed into the cavity 5 of the base 2 so as to obtain a desired height.

The head 4 is associated with the intermediate element 3 by passing the teeth 8 through the central through hole 17 using the loops 172, and then rotating it so that the lower surfaces of the teeth 8 come into sliding contact with the central surface 16.

Without the open ring 100, the head 4 may tilt with respect to the intermediate element 3: the curved edged 131 of the ribs 13 form a curved surface able to slide on the concave upper surface 7 of the intermediate element 3, while the teeth 8 slide on the central surface 16 of the head 4 until an optimal orientation of the outer upper surface 10, where the floor planes will rest, is found.

Alternatively, if the plane on which the base 2 rests is such to not require the tilting function, the open ring 100 is removed from the base 2 and it is coupled to the central element 80 so that it embraces the circular surface 82 of the circular neck 81 (FIGS. 6-9), thus allowing only the rotation of the head 4 with respect to the intermediate element 3 about an axis perpendicular to the support surface of the base 2; the tilting movement is not permitted. As it is clearly visible in FIG. 5, the internal edge of the central through hole 17 of the head 4 is in contact with the external edge of the open ring 100, thus blocking movements other than the simple rotation about the axis perpendicular to the support surface of the base 2 of the support 1.

Advantageously, with the same base 2, the same head 4 and the same intermediate element 3 it is possible to create two types of supports 1, one with a tilting function (without an open ring 100) and one without a tilting function (with an open ring 100 coupled to the circular neck 81).

The shape of the lower surface of the teeth 8 allows an effective sliding of the head 4 on the intermediate element 3, without sticking or breaking the teeth 8, the plurality of the teeth 8 avoiding, however, accidental movements.

Alternatively, the convex surfaces may be concave and vice versa.

Therefore, the upper surface of the intermediate element 3 is generally curved, preferably concave but alternatively convex. If the central surface 16 of the upper portion 15 of the head 4 is curved, it is preferably concave but alternatively convex; the curved surface of the lower portion 12 of the head 4 is preferably convex but alternatively concave.

Alternatively to the embodiment described above and shown in the Figures, the upper surface of the intermediate element 3 may be convex, the central surface 16 of the upper portion 15 of the head 4 may be convex, and the lower portion 12 of the head 4 may provide a concave surface: in the absence of the open ring 100, the head 4 is still able to tilt on the intermediate element 3.

FIGS. 11-16 show an embodiment of the head with locking teeth 14. This is an additional feature which does not affect the advantageous functionality of the open ring 100, but which, in addition, may lock the rotation of the head 4 on the intermediate element 3 after the coupling. Thereby, it is possible to rotate the intermediate element 3 with respect to the base 2, thus also modifying the height of the support 1, simply by rotating the head 4 which, by means of the coupling of the locking teeth 14 with the locking seats 84, becomes integral with the intermediate element 3.

The coupling between the locking teeth 14 and the locking seats 84 is reversible.

With or without the locking teeth 14, the support 1 according to the present invention is able to transform from non-tilting to tilting simply by using or not using the open ring 100.

The use of the open ring 100 is very simple, being elastic and easily maneuverable by the user: a slight widening of the opening of the open ring 100 due to elastic deformation allows the circular surface 82 of the circular neck 81 to be embraced.

The factory fixing of the open ring 100 to the base 2 ensures the availability thereof in case of need. It is alternatively possible to provide a seat in the base 2 in which to store the open ring 100 after use.

Figure 17:
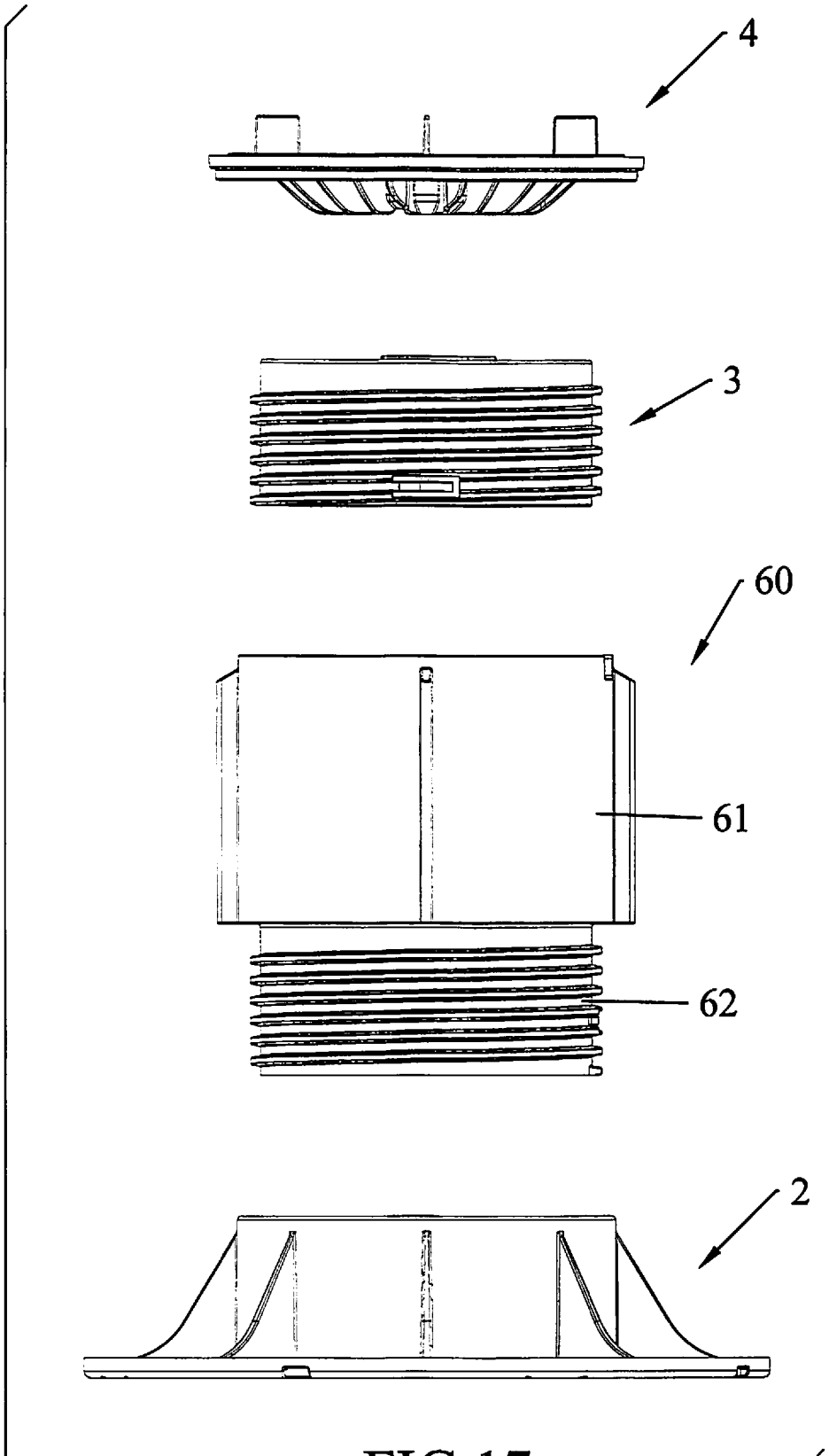
FIG. 17 shows an exploded side view of the support with an extension.

With reference to FIG. 17, an extension 60 may be mounted between the base 2 and the intermediate element 3, which allows the height of the support 1 to be extended.

The extension 60 comprises a nut portion 61 which couples with the external thread 6 of the intermediate element 3, and a screw portion 62, under the nut portion 61, which couples with the internal thread 51 of the base 2.

The invention claimed is:

1. A support for raised floors comprising a base, an intermediate element and a head on which raised floor portions rest, wherein the support selectively allows both a tilting movement of the head on the intermediate element, and only a rotation movement of the head on the intermediate element about an axis perpendicular to a plane on which the base rests, wherein the base comprises a cylindrical cavity having an internal thread, the intermediate element has a cylindrical shape with an external thread and comprises a curved upper surface and central teeth, wherein each tooth protrudes outwards leaving a space below, the head comprises an upper portion with an outer upper surface which is flat, and a central compartment comprising a central surface with a central through hole, the head further comprises a lower portion with a curved surface, the through hole is provided with curved edges interrupted by loops which protrude outwards to allow the passage from below of the teeth through the through hole, the curved upper surface of the intermediate element slidingly coupling with the curved surface of the lower portion of the head, wherein the intermediate element is centrally provided with a circular element which comprises a circular neck from which the teeth protrude outwards, wherein the support further comprises an open ring adapted to be reversibly coupled to the circular neck under the teeth, wherein the tilting movement of the head on the intermediate element is enabled when the open ring is decoupled from the circular neck, and is disabled when the open ring is coupled to the circular neck, wherein, when the open ring is coupled to the circular neck and the internal edge of the through hole of the head is in contact with the external edge of the open ring, the head can only rotate on the intermediate element about an axis perpendicular to the plane on which the base rests, and the open ring is elastic to elastically deform in order to embrace the circular neck.

2. The support according to claim 1, wherein an inner diameter of the undeformed open ring is substantially equal to an outer diameter of the circular neck so the open ring embraces the circular neck.

3. The support according to claim 1, wherein the open ring is integral with the base with breakable connections so as to be easily and irreversibly separated from the base.

4. The support according to claim 1, wherein the curved surface of the lower portion of the head comprises a plurality of curved edges of respective ribs.

5. The support according to claim 1, wherein the teeth have a curved lower surface adapted to slide on the central surface of the head.

6. The support according to claim 1, wherein the curved upper surface of the intermediate element is concave, the central surface of the upper portion of the head is concave, and the curved surface of the lower portion of the head is convex.

7. The support according to claim 1, wherein the lower portion of the head has locking teeth for coupling with locking seats of the intermediate element in order to lock the rotation of the head on the intermediate element.

* * * * *